United States Patent [19]

Badaliants et al.

[11] 4,152,227

[45] May 1, 1979

[54] METHOD FOR EXTRACTION OF GALLIUM FROM ALUMINATE-ALKALINE SOLUTIONS IN THE PRODUCTION OF ALUMINA FROM ALUMINUM-CONTAINING ORES

[76] Inventors: Khoren A. Badaliants, ulitsa Sportivnaya, 4, kv. 37, Pikalevo Leningradskoi oblasti; Leonid M. Butorin, ulitsa Gavanskaya, 10, kv. 18; Ioan V. Davydov, ulitsa Nalichnaya, 40, korpus 2, kv. 148, both of Leningrad; Anna E. Danilina, ulitsa Fedora Poletaeva, 8, korpus 5, kv. 63, Moscow; Jury N. Evseev, ulitsa Auezova, 64/1, kv. 50, Alma-Ata; Alexandr V. Eljutin, 3 Frunzenskaya ulitsa, 7, kv. 176, Moscow; Arkady I. Zazubin, ulitsa Vinogradova, 33, kv. 20, Alma Ata; Mikhail I. Zaitsev, prospekt Budennogo, 30, kv. 11, Moscow; Isaak A. Zatulovsky, ulitsa Sovetskaya, 29, kv. 46, Pikalevo Leningradskoi oblasti; Raisa V. Ivanova, ulitsa Udaltsova, 14, kv. 181, Moscow; Ivan M. Kostin, ulitsa Sportivnaya, 4, kv. 16, Pikalevo Leningradskoi oblasti; Vladimir V. Krasavin, 7 Mikroraion, 2, kv. 16, Achinsk Krasnoyarskogo kraya; Georgy I. Lazarev, ulitsa Marata, 1 kv. 15, Volkhov Leningradskoi oblasti; Nikolai A. Novikov, ulitsa Korolenko, 4/14, kv.10, Moscow; Tatyana D. Ostapenko, ulitsa Mira, 144, kv. 57, Alma-Ata; Gennady A. Panasko, ulitsa Novaya, 36, kv. 52, Pushkin Leningradskoi oblasti; Alexandr V. Peredereev, M:Filevskaya ulitsa, 40, kv. 25, Moscow; Avgusta I. Samoilova, ulitsa Lomonosova, 21, kv. 9, Volkhov Leningradskoi oblasti; Ljubov B. Samaryanova, Dmitrovskoe shosse, 153/43, kv. 45, Moscow; Larisa I. Sinelnikova, ulitsa Petra Alexeeva, 2/44, kv. 24, Leningrad; Anatolia I. Simanova, ulitsa Sovetskaya, 56, kv. 65, Pikalevo Leningradskoi oblasti; Evgeny M. Steshenko, Volkhovsky prospekt, 39, kv. 34, Volkhov Leningradskoi oblasti; Nikolai I. Eremin, prospekt Elizarova, 20, kv. 28, Leningrad; Petr V. Fedorin, ulitsa Molodezhnaya, 4, kv. 45, Volkhov Leningradskoi oblasti; Leonid I. Finkelshtein, ulitsa Chkalova, 45, kv. 2, Achinsk Krasnoyarskogo kraya; Elena L. Shalavina, ulitsa Vinogradova, 33, kv. 20, Alma Ata; Nikolai S. Shmorgunenko, I Linia, 28, kv. 15, Leningrad, all of U.S.S.R.

[21] Appl. No.: 862,397

[22] Filed: Dec. 20, 1977

[30] Foreign Application Priority Data

Dec. 22, 1976 [SU] U.S.S.R. ..... 2428005

[51] Int. Cl.[2] ..... C25C 1/22

[52] U.S. Cl. ..... 204/105 R; 75/109

[58] Field of Search ..... 423/122, 124, 129, 121; 75/109; 204/105 R

[56] References Cited

U.S. PATENT DOCUMENTS

| | | | |
|---|---|---|---|
| 2,582,376 | 1/1952 | Frary | 204/105 R |
| 2,582,377 | 1/1952 | Brown | 204/105 R |

*Primary Examiner*—R. L. Andrews

*Attorney, Agent, or Firm*—Lackenbach, Lilling & Siegel

[57] ABSTRACT

The starting aluminate-alkaline solutions are subjected to two-stage carbonization with stirring and the production of hydrate of aluminum oxide, a gallium-containing precipitate, and solutions containing caustic and bicarbonate alkali, thereafter the produced gallium-containing precipitate is mixed with a solution containing caustic alkali to achieve a content of gallium in the solution of 0.05 to 1 g/l, the precipitate thus formed is separated and the solution enriched with gallium is mixed with a solution containing bicarbonate alkali, the produced mixture is evaporated to separate compounds of alkali metals, and the evaporated solution is carbonized to produce a solution containing alkali metal salts, and a gallium concentrate from which gallium is produced by transforming it into alkaline solution and subsequently reducing electrochemically.

The proposed method makes it possible to extract gallium at a comparatively low cost from solutions in the processing, for example, of nephelines containing it in amounts which do not exceed 0.02 to 0.03 g/l. Owing to the proposed method it has become possible in the processes of concentration of gallium to produce a number of valuable components such as alkali metal salts contained in the starting ore.

7 Claims, No Drawings

METHOD FOR EXTRACTION OF GALLIUM FROM ALUMINATE-ALKALINE SOLUTIONS IN THE PRODUCTION OF ALUMINA FROM ALUMINUM-CONTAINING ORES

The invention relates to the technology for the production of rare metals from intermediate products in the processing of high-silicon aluminum-containing ores and can be used for extracting gallium from solutions in the processing of alkaline alumino-silicate raw materials such as nephelines.

FIELD OF APPLICATION

The method is suitable for extracting gallium from solutions containing carbonates, phosphates, chlorides, aluminates, vanadates, chromates, molybdates, silicates, ferrites, and zincates of alkali metals. Solutions having such composition are present in the processing of nephelines.

Gallium is used as a component of semi-conductor compounds of the $A'''$ $B^{v}$ type, alloys for dental fillings, liquid current collectors in electrical machinery, working media in radiation circuits, and in high-temperature thermometers.

Nephelines relate to alkali alumino-silicate ores mainly containing the following ingredients, mass percent: aluminum oxide — 15 to 30, alkali metal oxides — 5 to 20, silicon dioxide — 40 to 60, calcium oxide — 1 to 10, and iron oxides — 1 to 15.

Apart from said ingredients nepheline contains up to 30 to 150 mg/t of rare elements including gallium up to 10 to 40 mg/t.

Bearing in mind a comparatively high, compared to bauxites, specific consumption of nepheline for the production of one ton of alumina, the technology of processing of this raw material provides practical conditions for obtaining rare elements, including gallium, from intermediate products of aluminia production.

BACKGROUND OF THE INVENTION

At present gallium is mainly produced in processing high-quality ores such as bauxites.

Bauxites are practically not processed with the only purpose of extracting gallium. It is produced concurrently from intermediate products in which it is concentrated in processing beuxites to produce alumina.

In the Bayer processes for the treatment of beuxites 75% of gallium passes into aluminate solution as sodium gallate.

As a result of incomplete decomposition of bauxite slimes formed after leaching also contain gallium (about 30% of its content in the initial ore). When aluminate solutions are further processed gallium is again distributed between the solution and the aluminum hydroxide precipitate. The accumulation of gallium in the solution results in an increase of concentration of gallate which, in turn, increases its coprecipitation with aluminum.

After separation of the bulk of aluminum the concentration of gallium in the solution is 0.15 to 0.5 g/l.

Thus, it is the aluminate solution that is industrially important for producing gallium from bauxites.

The production of gallium from aluminate solutions takes two directions:

production of gallium concentrate, and direct extraction of gallium from said aluminate solutions.

It has been practically established that the content of gallium in the aluminum hydroxide precipitate depends on its content in the solution. Therefore, a certain alteration in the process of precipitation of aluminum hydroxide from the alkaline-aluminate solution may considerably reduce the amount of gallium in aluminum hydroxide. Gallium precipitates at the end of the process. A mixture of hydroxides produced by this method contains 0.2 to 3% of gallium by mass and is a raw material for its extraction.

In the known method the reusable aluminate solution of the Bayer process is treated with lime in autoclaves for precipitation of most of aluminum as calcium aluminate. After separation of the precipitate by filtration under pressure the solution is treated with carbon dioxide to produce a precipitate containing 0.3 to 1% of gallium by mass (see Acta Chemic., Sci.Acad.Hung., 1956, No. 14, p.1).

In another known method the bulk of aluminum, up to 90% by mass, is precipitated by carbonization, i.e. by treatment of the aluminate-alkaline solution with carbon dioxide, with stirring, the precipitate of hydrate of aluminum oxide is separated, and the remaining solution, containing caustic alkali, is subjected to recarbonization to produce a solution containing bicarbonate alkali, and a gallium-containing precipitate, comprising, in percent by mass: gallium oxide, 0.45; aluminum oxide, 47.4; sodium oxide, 18.4; carbon dioxide, 23.6; and water, 9.5 (see U.S. Pat. No 2,574,008).

After dissolving the gallium-containing precipitate with alkali, gallium is extracted by electrolysis from the aluminate-gallate solution produced. Electrolysis is carried out in stainless steel baths with stainless steel cathodes and anodes. The process is conducted at 3 to 4 V depending on the composition of the solution.

In a third method gallium is reduced from the aluminate-gallate solution by electrolysis on mercury or sodium amalgam (see French Pat. No. 1,261,344, and Journal of Metals, 1956, No. 8, p.1528).

As distinct from bauxites, nephelines contain a considerable amount of alkalis in the form of alkali metal oxides.

The necessity of removing alkali from the processing of nephelines reduces the frequency of circulation of solutions in the technological cycle of production of alumina, and the content of gallium in the aluminate-alkali solutions does not exceed 0.02 to 0.03 g/l.

Extraction of gallium from such solutions by electrochemical reduction is practically impossible, and the known methods of concentration do not make it possible to produce gallium concentrate from which it would be economically profitable to extract gallium.

The known methods for processing such low-quality aluminum-containing ores as clays, kaolins, alunites, and slates do not provide prerequisites for using them for concentration of gallium in processing nephelines either.

Thus, a review of the known methods for processing aluminum-containing ores and methods for concentration of gallium in them which make it profitable to extract gallium from intermediate products in the production of alumina, shows that it is impossible to employ the known methods for the production of gallium in processing nephalines.

It is an object of the invention to provide such a method wherein it is possible, at a comparatively low cost, to extract gallium from aluminate-alkaline solutions in the processing of high-silicon aluminum-containing ores such as nephelines.

BRIEF DESCRIPTION OF THE INVENTION

This object is achieved by a method for extraction of gallium from aluminate-alkaline solutions in the production of alumina from aluminum-containing ores wherein said solutions are subjected to two-stage carbonization with stirring and production of hydrate of aluminum oxide, gallium-containing precipitate and solutions containing caustic and bicarbonate alkali, and separation of gallium from said gallium-containing precipitate, so that, according to the present invention, the gallium-containing precipitate is mixed with the solution containing caustic alkali to a concentration of gallium in the solution produced equal to 0.05 to 1 g/l, the precipitate formed is separated, the solution enriched with gallium is mixed with the solution containing bicarbonate alkali, the mixture of solutions produced is evaporated to separate compounds of alkali metals, and the evaporated solution is subjected to recarbonization to produce a solution, containing salts of alkali metals, and gallium concentrate from which metallic gallium is produced by transforming it into alkaline solution and by subsequent electrochemical reduction.

This makes it possible, at a comparatively low cost, to extract gallium from solutions in the processing of, for example, nephelines which contain it in amounts that do not exceed 0.02 to 0.03 g/l. The high efficiency of the proposed method is not only explained by the efficiency of methods for concentration and extraction of gallium, but also by the processes of concentration of gallium wherein a number of valuable components are produced, such as alkali metal salts contained in the initial ore. The processes of concentration are carried out employing techniques characteristic of the basic alumina production, and they do not require special equipment and auxiliary substances and materials which are not used in alumina production. The expenditures on the production of 5 to 10 tons of gallium per year are repaid not more than one or two years.

In the proposed method the gallium-containing precipitate produced after carbonization should be mixed with the solution containing caustic alkali, so that the mixing should be preferably conducted at a temperature of 60° to 200° C. This makes it possible to enrich the solution to a content of gallium of 0.05 to 1 g/l , i.e. considerably increase the concentration of gallium in the solution, as compared to the initial aluminate-alkaline solution.

With a view to providing for optimal conditions for producing the final gallium concentrate, the evaporated solution, according to the present invention, should be subjected to recarbonization to a content of bicarbonate alkali of 30 to 200 g/l as calculated for potassium bicarbonate.

It is advisable to wash the gallium concentrate, produced as a result of recarbonization, with water prior to extraction of gallium therefrom.

This technique makes it possible to produce an alkaline solution with a high gallium content from which subsequent electrochemical extraction of gallium as a metal takes place efficently and at low cost.

It is advisable to extract gallium from the alkaline gallium-containing solution produced by electrochemical reduction using gallium-based materials. Electrochemical reduction of gallium from the solution is in this case the best method for the production of metallic gallium since, for example, both in cementation and in electrolysis, gallium is produced with a content of the basic substance of 99.9 to 99.95% by mass.

According to the present invention, said material, the basis of which is gallium, used in extraction of gallium from the alkaline solution by cementation is a gallium alloy containing aluminum. It is also advisable, according to the present invention, to use as said material a gallium-pool cathode in extraction of gallium from the alkaline solution by electrolysis. Depending on the composition of the solution and the equipment used, extraction of gallium is 80 to 95% by mass and the duration of the process is 2 to 6 hours.

Other objects and advantages of the present invention will be better understood from the detailed description of the proposed method and specific examples of its embodiment given below.

DETAILED DESCRIPTION OF THE INVENTION

The solutions produced in processing high-silicon aluminum-containing ores contain, on the average, in gl/1: alkali metal oxides — 80 to 120, aluminum oxide — 50 to 100, silicon dioxide — 0.01 to 0.1, iron — 0.01 to 0.1, organic substances — 0.2 to 1. The gallium content in these solutions is 0.01 to 0.03 g/l. This solution is subjected to two-stage carbonization which is carried out, for example, with carbon dioxide at a temperature of 60° to 100° C. with continuous stirring.

Apart from carbon dioxide solutions containing bicarbonate alkali or products containing carbon dioxide, for example, carbonate ion, can be used for carbonization. Used as such product can be precipitates produced after the second stage of carbonization of the aluminate-alkaline solution.

At the first stage of carbonization in the solution caustic alkali passes into carbonate alkali, their ratio changes and conditions are provided for the reaction of hydrolysis of sodium aluminate. As a result of hydrolysis the soluble compound — sodium aluminate — is transformed into hydrate of aluminum oxide, a compound whose solubility is low with the given composition of the solution and which is separated from the solution as a precipitate.

Carbonization at the first stage is conducted to separate of 50 to 95% by mass of aluminum present in the solution. Thereafter the precipitate of aluminum hydroxide is filtered to produce a solution mainly containing, in g/l; sodium oxide — 90 to 130, aluminum oxide — 3 to 25, gallium — 0.010 to 0.02, silicon dioxide — 0.03, organic substance — 0.010, and chlorine — 0.3. This solution is subjected to the second stage of carbonization which is conducted to a content of sodium bicarbonate in a solution of 10 to 50 g/l. Gallium together with aluminum is precipitated as alumino-carbonate of alkali metals enriched with gallium, which contains on the average, in % by mass: alkali metal oxides — 27 to 30, aluminum oxide — 27 to 30, carbon dioxide — 25 to 30, and gallium — 0.03 to 1. The alumino-carbonate precipitate containing gallium is separated from the solution containing bicarbonate alkali, washed with water and mixed with the solution containing caustic alkali.

We have found that the best results in obtaining a solution enriched with gallium to 0.05 to 1 g/l are attained when a solution is used containing free caustic alkali.

Gallium is selectively transformed into solution and its content therein increases to the above values. It is not advisable to carry out mixing to a concentration lower than 0.05 g/l of gallium in the solution since this does not make it possible to later obtain solutions from which it would be profitable to extract gallium. To achieve a concentration of gallium in the solution of more than 1 g/l is costly and difficult because of a low content of gallium in precipitates obtained after the second stage of carbonization of the aluminate- alkaline solution. The mixing is best carried out at a temperature of 60° to 200° C. Below 60° C. leaching of gallium from the precipitate is slow and the extraction becomes costly. The carrying out of this operation at a temperature of over 200° C. involves a very great power consumption and the rate of the process increases only slightly.

After mixing the alumino-carbonate gallium-containing precipitate with the solution containing caustic alkali, gallium from the alumino-carbonate precipitate passes into solution and aluminum contained in the precipitate as alumino-carbonate, is transformed into hydrate of aluminum oxide which can be used as a target product or an intermediate product in the processes of production of alumina. Depending on the conditions of production the enriched solution contains 0.05 to 1 g/l of gallium. This solution is mixed with the previously-prepared solution containing bicarbonate alkali. We have established that the best conditions for mixing these solutions are achieved when the content of caustic alkali in the mixed solution is above O. Such solutions best lend themselves to evaporation with separation in this process of target products, such as soda and potash. Since the solution containing bicarbonate alkali also comprises a certain amount of gallium, the proposed method makes it possible to maximize the use of these intermediate products in the alumina production for obtaining gallium.

The mixed solution with a content of caustic alkali of above O is subjected to evaporation in evaporation batteries where it is heated to a temperature of 130° to 200° C. and, as it reaches the state of saturation, in terms of concentration of salts, alkali metal salts such as sodium and potassium carbonates are separated.

As a result of evaporation a solution is produced which mainly contains, in g/l: alkali metal carbonates — 600 to 900, aluminum oxides — 10 to 50, alkali metal sulfates — 20 to 40, chlorine — 5 to 15, and gallium — 0.5 to 5.

Apart from said compounds the solution also contains other elements which are present in the starting raw material as impurities and distributed in the course of ore processing among different intermediate products.

The evaporated solution having said composition is subjected to recarbonization to produce gallium-containing precipitate — gallium concentrate. To this end carbon dioxide or a gas containing carbon dioxide is passed through the solution at a temperature of 60° to 100° C. The carbonization process is carried out to a concentration of alkali in the solution equal to 30 to 200 g/l, as calculated for sodium bicarbonate.

When carbonization is carried out to a content of bicarbonate alkali (potassium and sodium bicarbonate) of less than 30 g/l not all the gallium from the solution passes into precipitate. When the content of bicarbonate alkali is over 200 g/l sodium and potassium compounds pass into precipitate, the mass of the precipitate increases, and the concentration of gallium in it becomes lower.

In recarbonization, gallium passes into insoluble form and can be separated from the solution by filtration, settling or thickening. The precipitate produced mainly contains, in % by mass: alkali metal salts — 10 to 30, aluminum oxide — 25 to 40, carbon dioxide — 10 to 30, gallium —1 to 3, and silicon dioxide — 0.1 to 0.5.

The concentrate produced is treated with a solution containing caustic alkali, such solution being any of those used in alumina or soda production as well as mixture thereof. Apart from these solutions, spent electrolytes can be used for leaching gallium from the concentrate. Depending on the composition of the concentrate and the solution used for its treatment, it is advisable to adjust the content of aluminum and caustic alkali in the solution. This adjustment can be done before the treatment of the concentrate with the solution and during such treatment.

We have established that the best results of selectively passing gallium into alkali solution are achieved if the concentrate is pre-washed with water.

The washed concentrate is placed into a heated vessel together with the solution containing caustic alkali and stirred at a temperature of 80° to 130° C. for 1 to 4 hours. Gallium and some of aluminum pass into solution. The gallium content in the solution is 2 to 5 g/l. If it is required to adjust the solution intermediate products containing active calcium oxide are added to the slurry in the course of treatment. The solution produced after selectively leaching the concentrate mainly contains, in g/l: alkali metal salts— 90 to 150, aluminum oxide — 50 to 70, gallium — 2 to 5, silicon dioxide — 0.01 to 0.05, sulfate sulfur — 1 to 3, chlorine — 1 to 3, and iron — 0.001 to 0.003.

Gallium from this alkaline solution is extracted by electrochemical reduction on gallium-based materials. Metallic gallium is separated, for example, by cementation or electrolysis. It is preferable to carry out cementation by gallium alloys containing aluminum in an amount of 0.05 to 6% by mass. It is advisable to conduct electrolysis on a gallium-pool cathode at a cathode current density of 0.05 to 1 amp/cm$^2$. In both cases metallic gallium is produced which contains 99.90 to 99.95% by mass of the basic substance.

EXAMPLE 1

The starting aluminate-alkaline solution produced in the processing of nepheline and containing mainly, in g/l: total alkali — 91.2 including caustic alkali — 79.6, aluminum oxide — 70.1, gallium — 0.02, silicon dioxide — 0.03, chlorine — 0.25, sulfate sulfur — 2.7, organic substances — 0.1, taken in an amount of 200 m$^3$, is subjected to two-stage carbonization at a temperature of 75° C. The solution is stirred and a gas is passed therethrough containing 14% of carbon dioxide.

The first stage of carbonization is conducted to a content of caustic alkali of 5 g/l. After filtration hydrate of aluminum oxide and a solution caustic alkali are produced. The solution mainly contains, in g/l: total alkali —85 including caustic alkali — 4.5, aluminum oxide — 4.2, gallium 0.019. A portion of this solution is subjected to the second stage of carbonization to a content of bicarbonate alkali of 25 g/l. A precipitate is produced containing, in % by mass: sodium oxide — 26.3, aluminum oxide — 28.6, carbon dioxide — 26.1, gallium — 0.059, water — 16, silicon dioxide — 0.2, and a solution containing bicarbonate alkali.

The gallium-containing precipitate is mixed with the alkaline solution containing 50 g/l of caustic alkali. The process is carried out at a temperature of 60° C. for 6 hours to a content of gallium in the solution of 0.05 g/l. The solution produced contains, in g/l: total alkali — 120 including caustic alkali — 6.7, aluminum oxide — 4, and gallium — 0.07. This solution is mixed with the above-mentioned solution containing 25 g/l of bicarbonate alkali to reach a content of caustic alkali in the mixture of 0.5 g/l, and subjected to evaporation. The solution is heated to 130° C. by passing it through an evaporation battery. During evaporation sodium and potassium carbonates are separated from the solution. After evaporation the solution mainly contains, in g/l: total alkali — 356 including caustic alkali — 66.65, aluminum oxide — 60.2, gallium — 0.57, silicon dioxide — 0.2, sulfate sulfur — 3.48, and chlorine — 9.5. This solution is subjected to recarbonization by passing a gas containing 14% of carbon dioxide through a solution heated to 70° C. Carbonization is conducted to a content of bicarbonate alkali of 30 g/l, as calculated for sodium bicarbonate. The precipitate formed — gallium concentrate — containing, in % by mass: aluminum oxide — 30, gallium oxide — 1.3, is separated from the solution by filtration and washed with water in the filter.

Gallium passes from the precipitate into alkaline solution. The precipitate is loaded while stirring into a heated vessel with a solution containing, in g/l: total alkali — 124 including caustic alkali — 88.3, aluminum oxide — 5. The slurry is stirred for 2 hours at a temperature of 90°0 C. The solution produced contains, in g/l: total alkali — 144 including caustic alkali — 52, aluminum oxide — 36, and gallium — 2.0. Gallium is extracted from this solution by electrolysis on a gallium-pool cathode at a cathode current density of 0.05 amp/cm$^2$. The degree of extraction of gallium is 96%. The metal produced contains 99.9% by mass of gallium.

EXAMPLE 2

The starting aluminate-alkaline solution produced in the processing of nepheline (its composition is the same as that in Example 1) is subjected to two-stage carbonization at a temperature of 90° C. The solution is stirred and a gas containing 14% of carbon dioxide is passed through it. The first stage of carbonization is conducted to a content of caustic alkai of 30 g/l. After separation of the hydrate of aluminum oxide a portion of the remaining solution passes through the second stage of carbonization to a content of bicarbonate alkali of 50 g/l as calculated for sodium bicarbonate.

The precipitate produced contains, in % by mass: sodium oxide, 27.6; aluminum oxide, 30.1; carbon dioxide, 27.4; gallium, 0.027; water, 18, silicon dioxide, 0.23; and a solution containing bicarbonate alkali.

The resultant gallium-containing precipitate is mixed with the solution containing caustic alkali and produced as a result of causticization of the solution containing bicarbonate alkali. The composition of the solution containing caustic alkali after treatment with calcium oxide, in g/l: total alkali — 120 including caustic alkali — 91 as calculated for sodium oxide. The process is carried out at a temperature of 60° C. for 9 hours. The concentration of gallium in the liquid phase of the slurry increases to 0.5 g/l. The solution enriched with gallium is mixed with that containing bicarbonate alkali to reach a concentration of caustic alkali in the mixture of 1.3 g/l and evaporated as shown in Example 1. After evaporation the solution containing mainly, in g/l: total alkali — 376 including caustic alkali — 65, aluminum oxide — 56.1, and gallium — 1.6, is recarbonized to a content of bicarbonate alkali of 100 g/l as calculated for sodium bicarbonate, and the resultant precipitate is separated. The precipitate is washed with water in a filter. The washed precipitate contains, in % by mass: aluminum oxide — 65, alkali metal oxides — 14, and gallium — 1.7.

The precipitate is loaded into a heated vessel and mixed for 3 hours with a solution containing, in g/l: total alkali — 124 including caustic alkali — 76, and aluminum oxide — 31. While mixing, calcium oxide is added to the slurry in an amount of 1 mole per 1 mole of aluminum oxide in the precipitate. The concentration of gallium in the solution after leaching of the precipitate is 4.3 g/l. Gallium is extracted from the resultant solution by electrolysis on a gallium-pool cathode at a cathode current density of 0.1 amp/cm$^2$. The degree of extraction of gallium is 96%. The metal produced contains 99.9% by mass of gallium.

EXAMPLE 3

The starting aluminate-alkaline solution whose composition is the same as in Example 1 is subjected to two-stage carbonization to produce a hydrate of aluminum oxide, a gallium-containing precipitate, and solutions containing caustic and bicarbonate alkali as shown in Example 1.

The resultant gallium-containing precipitate is mixed with the alkaline solution containing 50 g/l of caustic alkali at a temperature of 130° C. for 2 hours. The content of gallium in the solution increases to 1.0 g/l. This solution is evaporated in mixture with the bicarbonate solution to reach a content of gallium in the solution of 5.6 g/l.

The evaporated solution is recarbonized as shown in Example 1 to produce a concentrate containing 2.5% by mass of gallium. The concentrate is separated from the solution by settling and filtration of the thickened portion of the slurry, washed with water in a filter, and the gallium contained therein is leached with a caustic solution. For this purpose the concentrate is mixed with the solution and heated to 130° C. for 1 hour. After filtration of the slurry the solution has the following composition, in g/l; total alkali — 146 including caustic alkali — 11.7, aluminum oxide — 7, and gallium — 5.2. This solution is treated with calcium oxide to raise the concentration of caustic alkali to 60 g/l. Gallium is extracted from the solution produced, by cementation with a gallium alloy containing 0.3% by mass of aluminum. The metal produced at a degree of extraction of 93% contains 99.95% by mass of gallium.

EXAMPLE 4

The starting aluminate-alkaline solution whose composition is the same as in Example 1 is subjected to two-stage carbonization as shown in Example 1.

The resultant gallium-containing precipitate is mixed with an evaporated solution containing mainly, in g/l: total alkali — 356 including caustic alkali — 66.65 aluminum oxide — 60.2, and gallium — 0.57. Hydrate of aluminum oxide is produced which is separated by filtration, and a solution mainly containing, in g/l: total alkali — 156 including caustic alkali — 7.2, aluminum oxide — 3.1, and gallium — 0.76. This solution is mixed with a solution containing bicarbonate alkali to reach a content of caustic alkali in the mixture of solutions produced of 1.4 g/l, after which said mixture is evaporated and recarbonized as shown in Example 1. The gallium concentrate separated from the solution contains 1.7% by mass of gallium. From said concentrate gallium is transformed into solution by treating the concentrate with lime milk so that the whole of alkali contained in the concentrate is transformed into caustic alkali. The lime milk is prepared by mixing the electrolyte with calcium oxide after separation of gallium by electrolysis. The solution produced contains, in g/l: total alkali — 111 including caustic alkali — 81, aluminum oxide — 30.3, and gallium — 4.17. Gallium is extracted from this solution by cementation with a gallium alloy containing 0.05% by mass of aluminum. The degree of extraction of gallium is 91%. The metal produced contains 99.92% by mass of gallium.

EXAMPLE 5

The starting aluminate-alkaline solution whose composition is the same as in Example 1 is treated, as shown in Example 1, to produce an evaporated solution containing mainly, in g/l: total alkali — 356 including caustic alkali — 66.65, aluminum oxide — 60.2, and gallium oxide — 0.57. The evaporated solution heated to 90° C. is subjected to recarbonization — treatment with a gas containing 10% of carbon dioxide. Carbonization is conducted to a content of 200 g/l of bicarbonate compounds of alkali metals. The precipitate produced containing mainly, in % by mass: aluminum oxide — 65, alkali metal oxides — 11, gallium — 1.3, is separated by filtration and treated with a solution containing 80 g/l of caustic alkali. The treatment is carried out at a temperature of 200° C. for 0.5 hour. After filtration of the slurry the solution mainly contains, g/l: total alkali — 137 including caustic alkali — 6.1, aluminum oxide — 2.7, and gallium — 3.52. This solution is adjusted with sodium oxide to a content of caustic alkali of 37 g/l and gallium is extracted therefrom at a temperature of 60° C. by cementation with a gallium alloy containing aluminum in an amount of 6% by mass. The metal produced at a degree of extraction of 93% contains 99.95% by mass of gallium.

EXAMPLE 6

The starting aluminate-alkaline solution produced in the processing of nepheline (its composition is the same as in Example 1) is processed, as shown in Example 1, to produce gallium-containing precipitate and a solution containing caustic alkali.

The gallium-containing precipitate is mixed with a solution containing 30 g/l of caustic alkali as calculated for sodium oxide. The process is conducted at a temperature of 150° C.

Said treatment resulted in producing hydrate of aluminum oxide meeting the requirements for the final product and a solution mainly containing, in g/l: total alkali — 115, including caustic alkali — 1.3, aluminum oxide — 0.85, and gallium — 0.19. This solution is mixed with that containing bicarbonate alkali to reach in the mixture a concentration of caustic alkali of 1.2 g/l. The resultant solution is evaporated at a temperature of 130° C. by passing it through an evaporation battery. In the course of evaporation carbonates of sodium and potassium are separated from the solution.

The evaporation is carried out before separation of hydroaluminates of alkali metals. The solution produced containing mainly, in g/l: total alkali — 371 including caustic alkali — 90.5, aluminum oxide — 61.7, and gallium — 5.4, is subjected to carbonization with carbon dioxide.

The process is conducted at a temperature of 95° C. so that, with a content of caustic alkali in the solution being 10 g/l, the slurry is thickened, the clarified and the thickened part are separated and the clarified part is carbonized to a content of bicarbonate alkali of 60 g/l as calculated for sodium bicarbonate. The resultant concentrate after washing with water mainly contains, in % by mass: aluminum oxide — 71, sodium oxide — 9.6, and gallium — 3.9.

Gallium is leached from the concentrate with a solution containing, in g/l: total alkali — 180 including caustic alkali — 166. After treatment of the precipitate the solution mainly contains, in g/l: total alkali — 113, including caustic alkali — 51, aluminum oxide — 31, and gallium — 12.1. Gallium is extracted from this solution by cementation with a gallium alloy containing aluminum in an amount of 0.5% by mass. The metal produced at a degree of extraction of 99.0% contains 99.91% by mass of gallium.

What is claimed is:

1. A method for extraction from aluminate-alkaline solutions in the production of alumina from high-silicon aluminum-containing ores which resides in subjecting said solutions to two-stage carbonization with stirring to produce hydrate of aluminum oxide, gallium-containing precipitate, and solutions containing caustic and bicarbonate alkali; mixing said gallium-containing precipitate with a solution containing caustic alkali to achieve a concentration of gallium in the solution equal to 0.05 to 1 g/l; separating the precipitate formed in said mixing, and mixing the solution enriched with gallium and remaining after separation of said precipitate, with the solution containing bicarbonate alkali, evaporating the mixture of solutions formed to separate compounds of alkali metals; recarbonizing the solution subjected to said evaporation to produce a solution containing alkali metal salts and gallium concentrate; transforming the gallium concentrate produced into an alkaline solution; reducing gallium electrochemically from said alkali solution of gallium concentrate.

2. A method as claimed in claim 1, wherein the gallium-containing precipitate is mixed with the solution containing caustic alkali at a temperature of 60 to 200° C.

3. A method as claimed in claim 1, wherein the evaporated solution is subjected to recarbonization to a content of bicarbonate alkali of 30 to 200 g/l as calculated for sodium bicarbonate.

4. A method as claimed in claim 1, wherein the gallium concentrate is washed with water prior to extraction of gallium therefrom.

5. A method as claimed in claim 1, wherein gallium is extracted from the alkaline solution by electrochemical reduction using gallium based materials.

6. A method as claimed in claim 5, wherein gallium is extracted from the alkaline solution by cementation with a gallium alloy containing aluminum.

7. A method as claimed in claim 5, wherein gallium is extracted from the alkaline solution by electrolysis with a gallium-pool cathode

* * * * *